United States Patent [19]

Delves

[11] 4,214,357

[45] Jul. 29, 1980

[54] PUNCHING DEVICE

[75] Inventor: Elsworth R. Delves, Lower Mackworth Village, England

[73] Assignee: Purpose Engineers Limited, Little Eaton, England

[21] Appl. No.: 6,501

[22] Filed: Jan. 25, 1979

[30] Foreign Application Priority Data

Feb. 16, 1978 [GB] United Kingdom ..... 06258/78

[51] Int. Cl.[2] ..... B23P 15/18

[52] U.S. Cl. ..... 29/233; 29/252; 83/554

[58] Field of Search ..... 29/233, 252; 83/554, 83/632; 72/453.03, 453.02, 450; 173/15

[56] References Cited

U.S. PATENT DOCUMENTS

| | | | |
|---|---|---|---|
| 1,448,868 | 3/1923 | Rollins | 29/252 |
| 3,756,145 | 9/1973 | Amacker | 100/269 R |
| 3,805,583 | 4/1974 | Sivin et al. | 72/453.03 |

FOREIGN PATENT DOCUMENTS

| | | | |
|---|---|---|---|
| 2213810 | 9/1973 | Fed. Rep. of Germany | 29/233 |

*Primary Examiner*—James L. Jones, Jr.
*Attorney, Agent, or Firm*—Michael J. Striker

[57] ABSTRACT

A rivetting machine for use with commercial vehicle brake-shoes, the machine having a punch holder, an anvil adjustable in height relative to the punch holder, a sprung rest for a brake shoe, and mechanism for linearly, operatively moving the punch holder, the mechanism comprising a lever actuable by a first pneumatic cylinder to take up free movement between a punch in the holder and a brake shoe on the rest, and a second pneumatic cylinder which produces further movement to effect a working operation on the brake shoe, a safety device being provided, so that, if, during the free movement, the punch holder meet resistance, the holder is immediately retracted.

11 Claims, 7 Drawing Figures

PUNCHING DEVICE

This invention is concerned with a punching device. The invention is particularly applicable to a punching device designed for removing rivets from a vehicle brake shoe to permit replacement of a brake lining and for rivetting the replacement lining to the shoe. Such devices are known, but provide for little travel of a tool in use and there is risk of injury to an operator.

The present invention provides a punching device comprising a tool holder mounted for linear movement, a linkage attached to the tool holder, a first piston-cylinder unit connected to the linkage and actuable to effect initial predetermined free movement of the tool holder in the operating direction, and a second piston-cylinder unit connected to the linkage and actuable at the end of said predetermined free movement to effect further working movement of the tool holder in the working direction.

Preferably, the tool holder includes a valve and a movable part for operating the valve to remove fluid pressure in the operating direction from the first piston-cylinder unit when, in use, a tool carried in said movable part contacts a surface during said free movement, and means for inactivating the valve at the end of said free movement. Advantageously, the first piston-cylinder unit is double-acting and the actuation of the valve causes fluid pressure to be applied in the reverse direction so as to retract the tool holder. This arrangement serves to protect the operator from injury during the free movement.

Also, preferably, the linkage comprises a lever fulcrummed on a pivoted arm and having one end part pivotally connected with the tool holder and the other end part pivotally connected with the second piston-cylinder unit, the fulcrum being movable relative to the lever, and the first piston-cylinder unit being connected with said arm for moving the fulcrum, whereby movement of the arm produces said free movement of the tool holder. This arrangement permits the device to be particularly compact.

Reference is now made to the accompanying drawings, wherein:-

Figure 1:
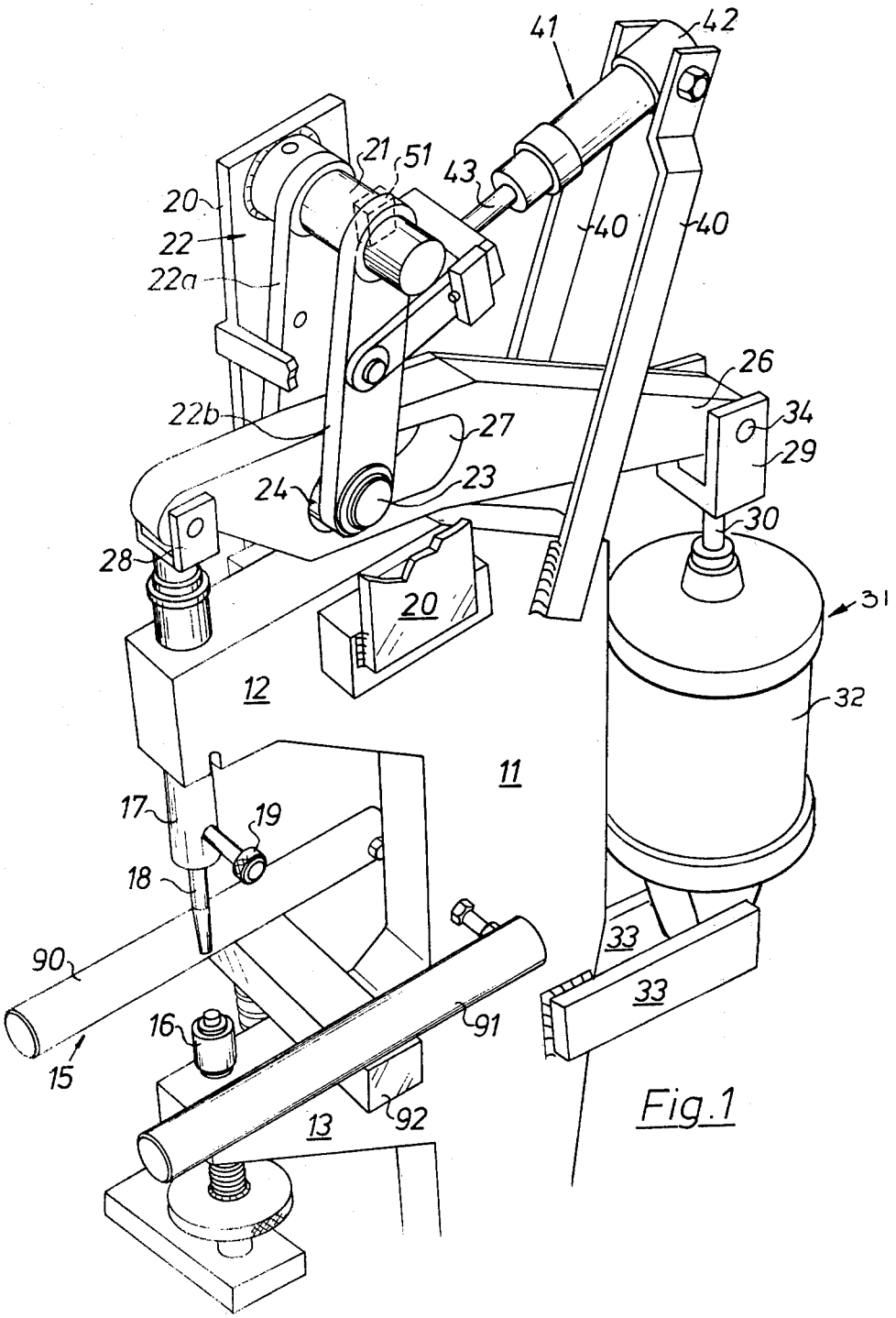
FIG. 1 is a perspective view of a device according to the invention.

The punching device shown comprises a body or stand 11 having upper and lower cantilever projections 12, 13. The lower cantilever projection 13 mounts a work-piece support 15 and a mandrel 16 which are more fully described hereafter. The upper cantilever projection 12 has a vertical, cylindrical aperture which slidably receives and guides a tool holder 17. As shown in the FIG. 1, the tool holder is holding a tool 18 in the form of a punch, held in place by a screw 19. A pair of upstanding lugs 20 projects upwardly from the stand and mounts a shaft 21 between the lugs. An arm 22 is pivotally mounted on the shaft, so as to be suspended between the lugs. The arm comprises a pair of spaced members **22*a*, 22*b* and at its lower end a shaft 23 rotatably mounts a roller 24** between the members.

A two-armed lever 26 is provided with an elongate slot 27, in which the roller 24 is received, the roller serving as a movable fulcrum for the lever. One end part of the lever is pivotally connected to the tool holder 17 by a clevis 28 and the opposite end part of the lever is connected by a clevis 29 to the piston rod 30 of a main, double-acting piston-cylinder unit 31 (hereafter called the "second unit") for pivotal movement about a pivot 34. The cylinder 32 of the second unit 31 is pivoted on brackets 33 on the stand 11. The arrangement of the slot 27 and the arm 22 is such that, with the second unit retracted and inoperative, as shown in FIG. 1, movement of the roller 24 in the slot causes pivotal movement of the lever 26 about the pivot 34, with accompanying linear movement of the tool holder 17.

Upstanding brackets 40, on the stand 11, pivotally mount the cylinder 42 of a smaller double-acting piston-cylinder unit 41 (hereafter called the "first unit"). The piston 43 of the first unit 41 is fixed to a clevis 44, which is pivotally connected to the arm 22 by a pivot 45 midway along the length of the arm. In FIG. 1, the first unit is shown in its extended position, in which the roller 24 is at the end of the slot 27 nearer to the tool holder 17. In this position, the angle between the arm 22 and the longitudinal axis of the first unit 41 and between the arm 22 and the length of the slot is approximately 90°. An upward force on the tool holder 17, therefore, acts substantially along the length of the arm without a tendency to urge the roller along the slot. The pivot 45 is slightly offset towards the tool holder 17 from axial alignment with the shaft 21 and the roller 24, so that such an upward force on the tool holder also does not tend to act against fluid pressure in the first unit 41.

Mounted on the clevis 44, at opposite sides thereof are on/off valves 50, 51. Each valve has an actuating button such as **50*a* shown in FIG. 2. The on/off valve 50 operates on actuation of the button 50*a* to switch penumatic pressure to the second unit 31. The purpose of the valve 51 is described with reference to FIG. 6**.

Figure 2:
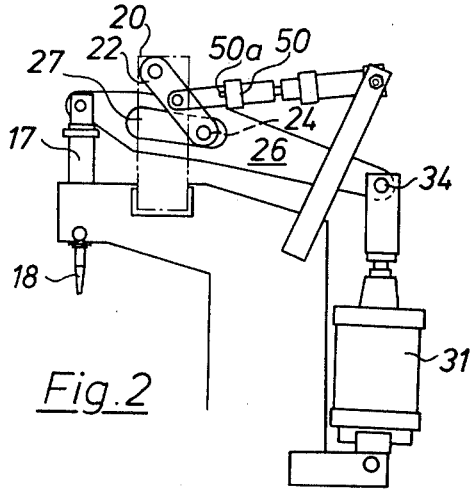
FIG. 2 is a diagrammatic side elevation of a part of the device showing a tool holder in a retracted position.
Figure 3:
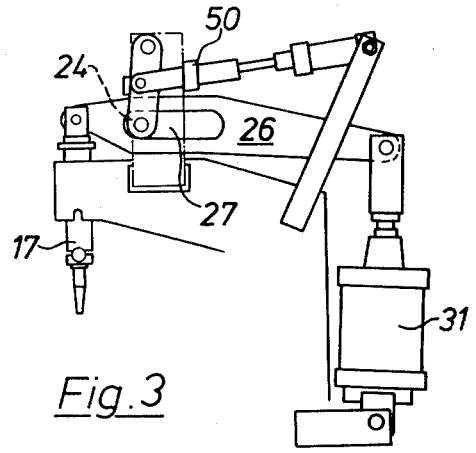
FIG. 3 is a view similar to FIG. 2, showing the tool holder partly advanced.
Figure 4:
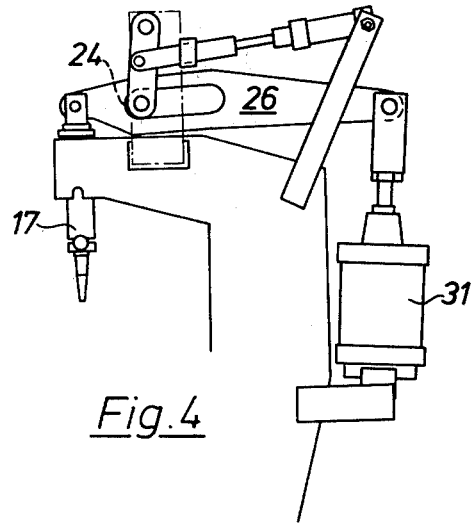
FIG. 4 is a view similar to FIGS. 2 and 3, showing the tool holder fully advanced.

In operation of the part of the device so far described, air under pressure is supplied initially to the first unit 41 to extend the unit, thereby causing the arm to be pivoted about the pivot shaft 21, so that the roller moves from the right-hand end of the slot 27 to the left-hand end of the slot, i.e. from the FIG. 2 position to the FIG. 3 position. This pivotal movement of the arm causes depression of the lever about the pivot 34, so that the tool holder 17 is moved downwardly. At the end of the stroke of the first unit, the on/off valve 50 abuts against one of the upstanding lugs 20, in the FIG. 3 position, so that the button **50*a* is depressed causing movement of the valve from the "off" to the "on" position. This permits air under pressure to be applied to the second unit 31, which is extended, causing pivoting of the lever 26 about the roller 24. As a result of this movement, the tool holder is further advanced, this further advancement being the operative movement of the tool holder in effecting work on a work-piece. The tool 18** shown is a punch, which may be used for removing rivets from a brake shoe.

Figure 5:
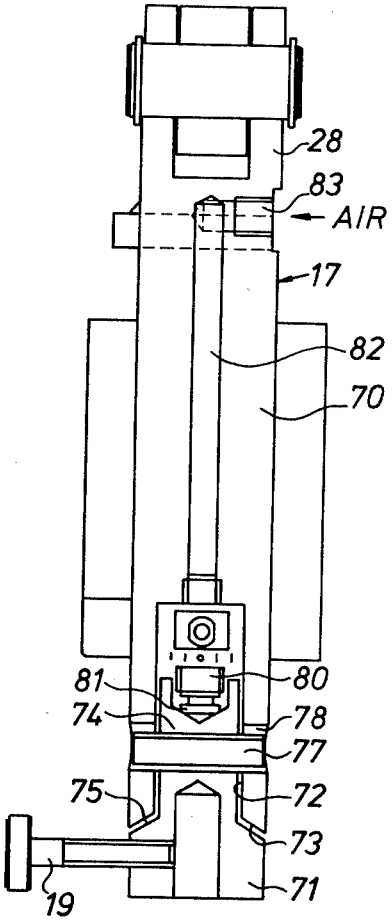
FIG. 5 is an enlarged sectional view of the tool holder.

During the extension of the first unit 41, contact of the tool 18 or tool holder 17 with an object, such as the operator's hand, causes immediate retraction of the first unit, so as to avoid damage or injury. To provide for this safety measure, the tool holder is provided, as shown in FIG. 5, with a shank 70 and a head 71. the head being movable relative to the shank. The shank has a bore 72 in its lever end, terminating at a bevelled shoulder 73. The head has a spigot portion 76 engaged in the bore and a complementary shoulder 75. A cross pin 77 in the spigot portion 74 engages at one end in a larger diameter aperture 78, so that a small degree of axial movement of the head 71 is permitted relative to the shank 70. A valve 80 is housed in the bore 72 and has an operating button 81, which is actuated on movement of the head relative to the shank. An air passage 82 leads to the valve 80 from an air inlet 83.

The air inlet 83 is connected with the first unit 41. The valve 80 is normally closed, but is opened when the head 71 is raised so as to actuate the button 81, causing bleed-off of the air through the apertures 78. This action is caused to reverse the operation of the first unit, as is described fully hereafter.

Figure 6:
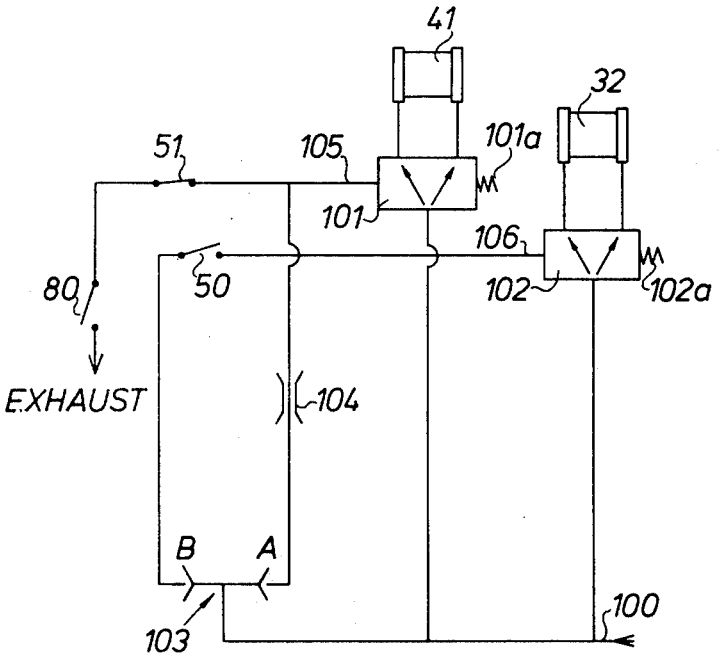
FIG. 6 is a pneumatic circuit diagram.

Referring now to FIG. 6, a pneumatic circuit is shown including the first unit 41 and the second unit 32. A main air line 100 feeds air under pressure to a first control valve 101 and to a second control valve 102. Both control valves are biased by springs 101*a* and 102*a* respectively, to feed the air to the side of the respective piston causing retraction of the corresponding unit.

The main air line 100 is also connected to a two-position, foot-operable valve assembly 103. This valve assembly has two outlets A and B, the outlet A being connected through a pressure-reducing restrictor 104 to a bias line 105 to the first control valve 101. The outlet B is connected to the bias line 106 of the second control valve 102. Actuation of the two-position valve assembly 103, in the first position, causes air pressure to be applied to the first bias line 101, which causes the first control valve 101 to reverse the air flow to the first unit, causing extension of the first unit. Further actuation causes air pressure to be applied additionally to the second bias line 106, so that the second control valve 102 reverses the air flow to the second unit, causing extension of the second unit.

As previously described, the second unit cannot be actuated until the on/off valve 50 is opened by actuation of its button 50*a* (FIG. 1), at the end of the stroke of the first unit 41.

The outlet A of the two-position valve assembly 103 is also connected, via the air inlet 83 and the passage 82 of the tool holder 17, to the valve 80 housed in the bore 72 of the tool holder. As explained above, this valve is normally closed, but actuation of the valve causes air to exhaust from the tool holder through the valve. This relieves pressure in the first bias line 105, so that the first unit is caused to retract.

A further valve 51 is shown in the exhaust line and has already been referred to with respect to FIG. 1. This valve 51 is normally open permitting exhaustion through the valve 80, as has just been described. This valve is, however, closed at the end of the extending stroke of the first unit, simultaneously with opening of the on/off valve 50 and in the same manner. This prevents exhaustion of air in the first bias line 105, so that the lever fulcrum, defined by the roller 24, cannot be moved whilst the second and main unit 31 is operating.

The two-position valve assembly 103 may comprise an actuator in the form of a plunger which is actuated by a foot pedal. Two valves may be provided offset axially of the plunger so that the plunger actuates the two valves successively. A spring stop may be provided to resist movement of the plunger after the first of these valves has been actuated, the bias of the spring stop having to be overcome to permit actuation of the other valve.

Figure 7:
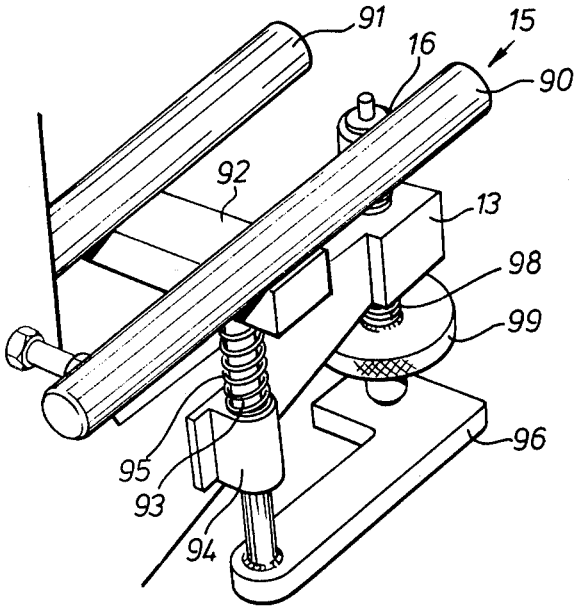
FIG. 7 is a perspective view of a work-piece support part of the device from the opposite side to that shown in FIG. 1.

Referring now to FIGS. 1 and 7, the work-piece support 15 comprises spaced tubular members 90, 91 mounted on a cross-bar 92. The cross-bar 92 carries a dependent rod 93 which is slidably engaged in a guide 94 on the lower cantilever projection 13. A helical spring 95 is located about the rod 93 and abuts against the cross-bar 92 at one end and the guide 94 at the opposite end. The rod carries a platform 96 at its lower end. The mandrel 16 is screw-engaged in one end of a screw 98. The screw is screw-engaged in the lower cantilever projection and its lower end abuts against the platform 96. A collar 99 is fixed to the screw 98 for turning the latter, so as to adjust the height of the mandrel. The support members 90, 91 are adjusted simultaneously with adjustment of the height of the mandrel under pressure of the spring 95.

In use, a brake shoe and lining are together placed on the support members 90, 91, so that the mandrel 16 engages with the head of a rivet engaged in a countersunk aperture in the lining, with the shank of the rivet projecting through an aperture in the shoe. The mandrel is adjusted, so that the stroke of the first unit 41 brings the punch 18 close to the shank of the rivet. The second unit 31 is then caused to operate, so that the punch deforms the shank of the rivet.

Rivets may also be removed using the device by means of an appropriate tool held in the tool holder, the mandrel being removed for this operation. With certain types of rivets, the deformed head may first have to be removed.

I claim:

1. A punching device comprising a tool holder mounted for linear movement, a linkage attached to the tool holder, a first piston-cylinder unit connected to the linkage and actuable to effect initial predetermined free movement of the tool holder in the operating direction, and a second piston-cylinder unit connected to the linkage and actuable at the end of said predetermined free movement to effect further working movement of the tool holder in the working direction.

2. A punching device according to claim 1, wherein the linkage comprises a lever fulcrummed on a pivoted arm, one end part of the lever being pivotally connected with the tool holder and the other end part being pivotally connected with the second piston-cylinder unit, the fulcrum being movable relative to the lever, and the first piston-cylinder unit being connected with said arm for moving the fulcrum, whereby movement of the arm produces said free movement of the tool holder.

3. A punching device according to claim 2, wherein the lever has an elongate slot and the fulcrum is in the form of a roller movable along the slot.

4. A punching device according to claim 1, having a fluid circuit including said first and second piston-cylinder units and including a valve actuable as the tool holder approaches the end of said predetermined free movement to permit actuation of the second piston-cylinder unit, the valve normally preventing such actuation.

5. A punching device according to claim 4, having a fluid circuit including said first and second piston-cylinder units, the tool holder including a second valve and a movable part for operating the second valve to remove fluid pressure in the operating direction from the first piston-cylinder unit, when, in use, a tool carried in said movable part contacts a surface during said free movement, and means for inactivating the second valve at the end of said free movement.

6. A punching device according to claim 5, wherein the first piston-cylinder unit is double-acting and the actuation of the second valve causes fluid pressure to be applied in the reverse direction so as to retract the tool holder.

7. A punching device according to claim 6, wherein the circuit includes a control valve normally biasing the first piston-cylinder unit in said reverse direction, a fluid line for actuating the control valve to cause movement of the first piston-cylinder unit in the operating direction, the second valve being in said fluid line and serving to connect the line to exhaust when actuated.

8. A punching device according to claim 7, wherein said means for inactivating the second valve comprises a third valve in said fluid line and actuable as the tool holder approaches the end of said predetermined free movement to isolate the fluid line from said second valve.

9. A punching device comprising a body, a tool holder mounted for linear movement in the body, a lever having one end part pivotally connected with the tool holder, the arm defining therein an elongate slot, a fulcrum member slidable in said slot, an arm pivotally mounted at one end on the body, said fulcrum member being mounted at the opposite end of said arm, the lever being fulcrummed on said fulcrum member, a first piston-cylinder unit connected to the arm for effecting movement of the fulcrum along said slot with accompanying angular movement of the lever, a second piston-cylinder unit connected to the lever to effect angular movement of the lever about the fulcrum member, a fluid circuit including said first and second piston-cylinder units, the tool holder including a first valve actuable, when the fulcrum member reaches the end of the elongate slot when moving in the operating direction, to permit actuation of the second piston-cylinder unit, the valve normally preventing such actuation, a second valve incorporated in the tool holder, the tool holder including a movable part for operating the second valve to remove fluid pressure in the operating direction from the first piston-cylinder unit when the movable part meets resistance to movement in the operating direction, and means for inactivating the second valve at the end of the stroke of the first piston-cylinder unit in the operating direction.

10. A brake-shoe rivetting machine device comprising a punch holder mounted for linear movement, a lever attached to the tool holder, a piston-cylinder unit attached to the lever for effecting linear movement of the tool holder, a rest for supporting a vehicle brake-shoe below the tool holder and comprising spaced support members, spring cushioning means acting on the rest, an anvil mounted below the tool holder and between said support members, and means for raising and lowering said anvil.

11. A brake-shoe rivetting machine according to claim 10, wherein the anvil is screw-mounted in the body of the machine and manipulatable means is mounted thereon to facilitate turning of the anvil to effect raising and lowering of the anvil.

* * * * *